US006336831B1

(12) United States Patent
Abe

(10) Patent No.: US 6,336,831 B1
(45) **Date of Patent: *Jan. 8, 2002**

(54) COMBINED CONNECTOR

(75) Inventor: Kimihiro Abe, Shizuoka (JP)

(73) Assignee: Yazaki Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/136,620

(22) Filed: Aug. 20, 1998

(30) Foreign Application Priority Data

Aug. 20, 1997 (JP) ..... 9-223764

(51) Int. Cl.[7] ..... H01R 15/502
(52) U.S. Cl. ..... 439/701; 439/717
(58) Field of Search ..... 439/701, 717, 439/718, 354, 350, 358

(56) References Cited

U.S. PATENT DOCUMENTS 3,848,951 A * 11/1974 Michaels et al. ..... 439/717
4,425,018 A * 1/1984 Stenz ..... 439/717
4,682,839 A * 7/1987 Bryce ..... 439/701
4,729,744 A * 3/1988 Bet et al. ..... 439/717
5,320,555 A * 6/1994 Okabe ..... 439/701
5,890,933 A * 4/1999 Okabe ..... 439/701

FOREIGN PATENT DOCUMENTS

JP 2-223171 9/1990 ..... H01R/13/514
JP 4-39822 2/1992 ..... H01R/13/00

* cited by examiner

*Primary Examiner*—Hien Vu
(74) *Attorney, Agent, or Firm*—Sughrue Mion, PLLC

(57) ABSTRACT

A combined connector in which a plurality of connector housings each including a plurality of terminal storage chambers therein are piled up on top of another and secured to one another in multiple stages in the vertical direction. In the combined connector, first securing projecting portions are provided in one of the mutually opposing upper and lower stage side connector housings arranged in the vertical direction, first securing recessed portions, into which the first securing projecting portions can be fitted, are provided in the other, second securing projecting portions and second securing recessed portions, into which the second securing projecting portions can be fitted, are respectively provided in a direction crossing at right angles to the first securing projecting and recessed portions, and introducing portions are provided in at least one of the first and second securing projecting portions.

11 Claims, 4 Drawing Sheets

COMBINED CONNECTOR

BACKGROUND OF THE INVENTION

1. Field of the Invention

The present invention relates to a combined connector in which a plurality of connector housings each including a plurality of terminal storage chambers can be simply connected together in a multiple-stage manner.

2. Description of the Related Art

As a combined connector of this type, there is known a combined connector which is disclosed in Japanese Patent Unexamined Publication No. Hei. 2-223171 and shown in FIGS. 4(*a*) to 4(*c*). This conventional combined connector 1, as shown in FIGS. 4(*a*) and 4(*c*), is composed of a connector housing 2 arranged on the lower-most stage side, connector housings 2' and 2' respectively arranged on the middle stage side and the upper-most stage side, and a cover 8 for covering an opening 3*a* formed in the connector housing 2' arranged on the upper-most stage side. In the respective connector housings 2, 2' and 2', there are formed a plurality of terminal storage chambers 3*b* for storing therein terminals (not shown). Also, in the front and rear portions of the two side walls 3 and 3 of each of the connector housings 2, 2' and 2', there are provided a pair of triangular-prism-shaped, upwardly located, provisionally securing projection 4 and, downwardly located, finally securing projection 5 in such a manner that they are respectively formed integrally with the side walls 3 and projected therefrom; and, on the opening 3*a* sides of the two side walls 3, 3, there are provided a pair of triangular-prism-shaped, right and left cover securing projections 6 and 6 formed integrally with and projectingly from the side walls 3, with the provisionally and finally securing projections 4 and 5 located between them.

As shown in FIGS. 4(*a*), 4(*b*) and 4(*c*), at the positions of the two side walls 3 and 3 of the connector housings 2' and 2' respectively arranged on the middle and upper-most stage sides, in particular that are respectively opposed to the above-mentioned respective securing projections 4 and 5, there are provided frame-shaped engaging pieces 7 and 7 in such a manner that they are formed integrally with their respective side walls 3 and are projected therefrom. Also, at the positions of the two side portions of the cover 8 that are respectively opposed to the above-mentioned respective securing projections 6, there are provided frame-shaped engaging pieces 9 in such a manner that they are formed integrally with their respective side portions and are projected therefrom. By pressing down the connector housing 2' on the upper-most stage side, as shown in FIG. 4(*c*), the combined connector 1 can be assembled. That is, as shown by two-dot chained lines in FIG. 4(*b*), the engaging pieces 7 are respectively fitted with the finally securing projections 5, and the engaging pieces 9 of the cover 8 are slidingly fitted with the cover securing projections 6, respectively. This completes such assembly of the combined connector 1 as shown in FIG. 4(*c*). By the way, a similar technology relating to the combined connector 1 is disclosed in FIG. 2 in Japanese Patent Unexamined Publication No. Hei. 4-39822.

However, in the above-mentioned conventional combined connector 1, when the respective connector housings 2, 2' and 2' are connected together (combined together), it is difficult to position them (that is, to match the centers thereof with each other): that is, as shown in FIG. 5, when the positions of the engaging pieces 7 are shifted in the right and left directions and, as shown in FIG. 6, when the positions of the engaging pieces 7 are shifted in the back and forth directions, it is difficult to pile up the respective connector housings 2, 2' and 2' on top of another and secure them to one another. Also, the piling-up and engaging forces of the respective connector housings 2, 2' and 2' are easy to vary and, even after they are combined together, there is a fear that there can be produced a clearance between the respective connector housings 2, 2' and 2' due to the insufficient piling-up and engaging forces.

SUMMARY OF THE INVENTION

In view of the above-mentioned circumstances, the present invention aims at eliminating the above-mentioned drawbacks found in the conventional combined connectors. Accordingly, it is an object of the invention to provide a combined connector which can prevent the respective connector housings from shifting in position in the back and forth directions and in the right and left directions when they are combined together, can reduce the variations in the engaging forces necessary for fitting engagement between the respective securing projections and engaging recessed portions, and can prevent production of a clearance between the respective connector housings after they are combined together.

In attaining the above object, according to the invention, there is provided a combined connector comprising: a plurality of connector housings each including a plurality of terminal storage chambers therein, the connector housings being piled up on top of another and secured to one another in multiple stages in their connecting direction; a first securing projecting portion which is provided in one of mutually opposing connector housings arranged in the connecting direction; a first securing recessed portion which is provided in the other of the mutually opposing connector housings and into which the first securing projecting portion is fitted; a second securing projecting portion which is provided in the one connector housing in a direction crossing at right angles to the first securing projecting and recessed portions; a second securing recessed portion which is provided in the other connector housing and into which the second securing projecting portion is fitted; and an introducing portion which is provided in at least one of the first and second securing projecting portions.

BRIEF DESCRIPTION OF THE DRAWINGS

FIG. 4(*b*) is an enlarged perspective view of securing means used in the conventional combined connector;

FIG. 4(*c*) is a perspective view of the conventional combined connector, showing a state thereof in which it is combined;

DETAILED DESCRIPTION OF THE PREFERRED EMBODIMENT

Now, description will be given below of an embodiment of a combined connector according to the invention with reference to the accompanying drawings.

Figure 1:
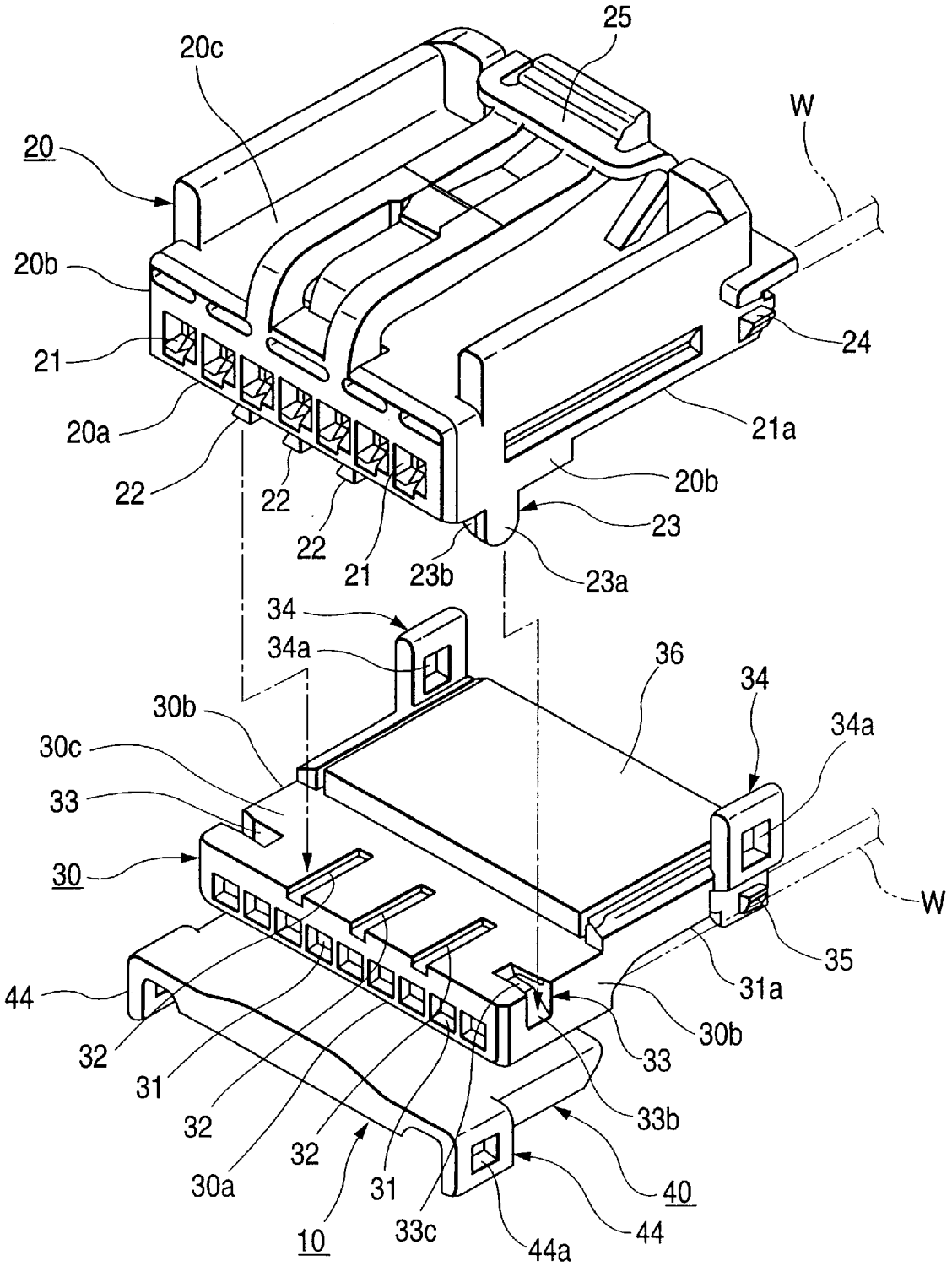
FIG. 1 is a perspective view of a first embodiment of a combined connector according to the invention, showing a state thereof before it is combined.
Figure 2:
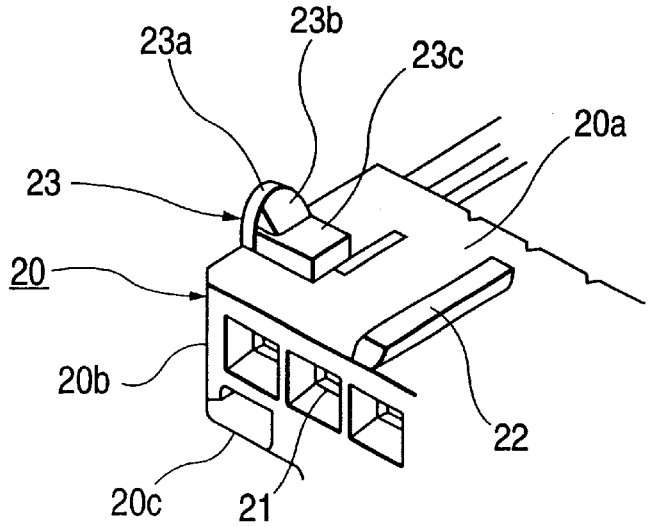
FIG. 2 is an enlarged perspective view of the main portions of a connector housing arranged on the upper stage side of the combined connector, when they are viewed from the bottom surface side of the combined connector.
Figure 3:
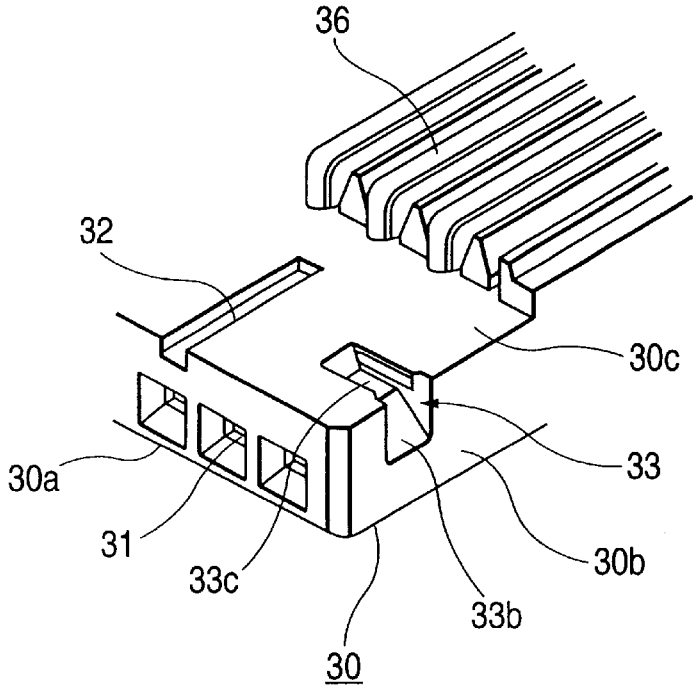
FIG. 3 is an enlarged perspective view of the main portions of a connector housing arranged on the lower stage side of the combined connector.
Figure 4A:
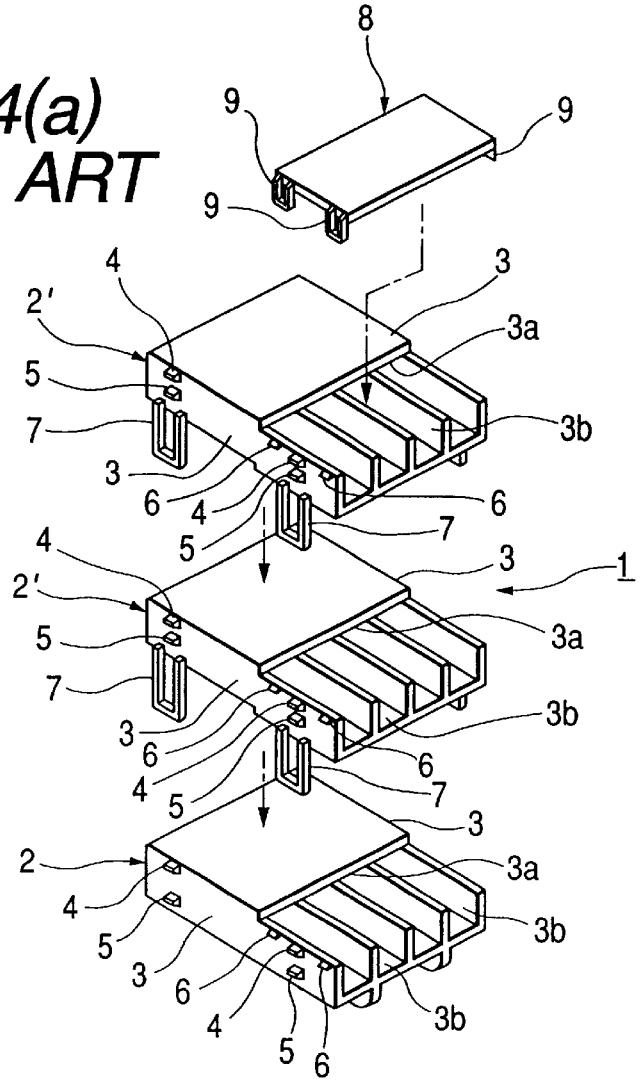
FIG. 4(a) PRIOR ART
FIG. 4(*a*) is an exploded perspective view of a conventional combined connector.
Figure 4B:
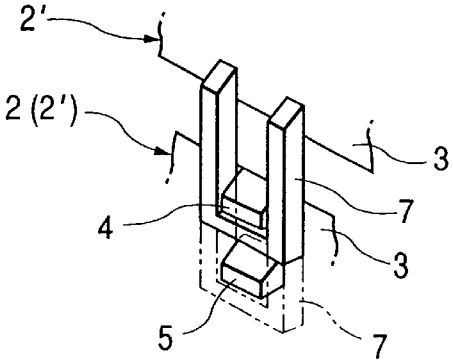
FIG. 4(b) PRIOR ART
Figure 4C:
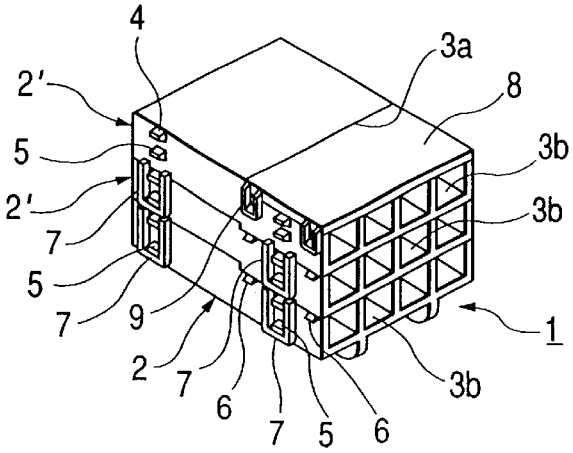
FIG. 4(c) PRIOR ART
Figure 5:
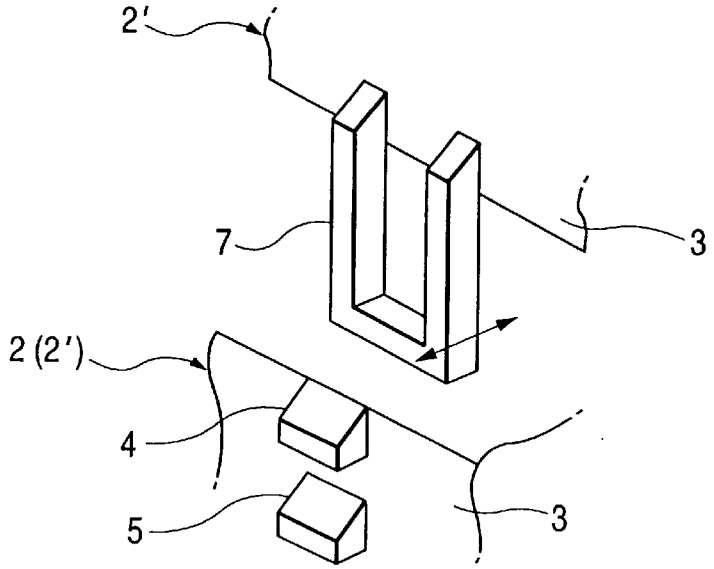
FIG. 5 PRIOR ART
FIG. 5 is a partially perspective view of the securing means used in the conventional combined connector, showing a state thereof in which the engaging piece side thereof is shifted in the right and left directions to thereby unable to pile up the connector housings one on top of another.
Figure 6:
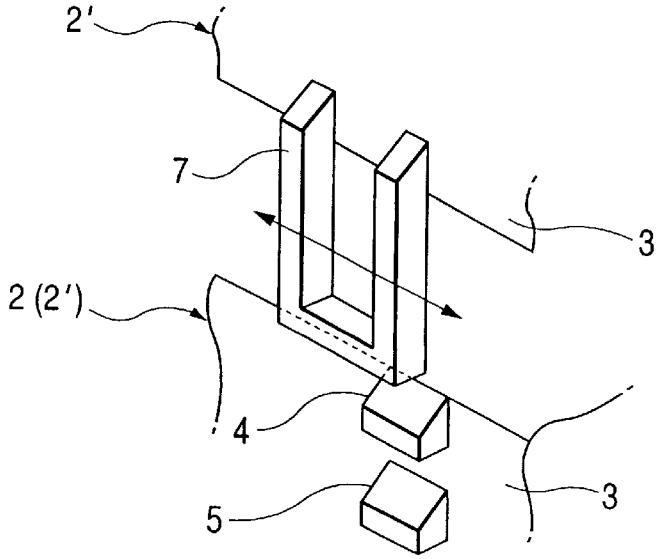
FIG. 6 PRIOR ART
FIG. 6 is a partially perspective view of the securing means used in the conventional combined connector, showing a state thereof in which the engaging piece side thereof is shifted in the back and forth directions to thereby unable to pile up the connector housings one on top of another.

In particular, FIG. 1 is a perspective view of the embodiment of a combined connector according to the invention, showing a state thereof before it is combined; FIG. 2 is an enlarged perspective view of the main portions of a connector housing arranged on the upper stage side of the combined connector, when they are viewed from the bottom surface side of the combined connector; and FIG. 3 is an enlarged perspective view of the main portions of a connector housing arranged on the lower stage side of the combined connector.

As shown in FIG. 1, a combined connector 10 comprises an upper stage side connector housing (one connector housing) 20 including a plurality of terminal storage chambers 21, a lower stage side connector housing (the other connector housing) 30 which includes a plurality of terminal storage chambers 31 and can be piled up onto and secured to the upper stage side connector housing 20, and a synthetic resin cover 40 which is disposed integrally with the lower stage side connector housing 30 through a hinge portion and a band portion (neither of which are shown) and is used to close an opening 31*a* side of the terminal storage chambers 31.

The upper stage side connector housing 20 is formed of synthetic resin in a substantially box-like shape and, between the front and rear end portions of the connector housing 20, there are formed, in parallel, a plurality of terminal storage chambers 21. The rear portion of a bottom surface 20*a* of the upper stage side connector housing 20 is formed as an opening 21*a* which is used to expose part of a terminal (not shown) stored in each of the terminal storage chambers 21 and one end side of an electric wire W connected to the present terminal. Also, as shown in FIGS. 1 and 2, in the central portion of the bottom surface 20*a* of the upper stage side connector housing 20, as well as on the two sides of the central portion, there are formed integrally and projectingly first securing projecting portions 22 each having a substantially trapezoidal section in such a manner that they extend in the longitudinal direction of the connector housing 20 and in parallel to one another. Further, formed on bottom surface 20*a* are second securing projecting portions 23 each having a substantially L-shaped front surface section. These second securing projecting portions 23 are formed at two end portions of the bottom surface 20*a* of the upper stage side connector housing 20 and in the front side portions of the two side surfaces 20*b* and 20*b* and extend at right angles to the first securing projecting portions 22.

As shown in FIGS. 1 and 2, each of the pair of right and left second securing projecting portions 23 and 23 includes a substantially tongue-shaped (substantially semi-disk-shaped) introducing portion or introducing rib 23*a* which is formed integrally with and is projected downward from the lower portion of the projecting portion 23 in such a manner that it is flush with the side surface 20*b*. Introducing tapered projecting portion 23*b*, which formed integrally with and projects from the leading end side of the circular portion of the introducing rib 23*a* in such a manner that it is inclined. A flat projecting portion 23*c* having a box-like shape, projects from the introducing tapered projecting portion 23*b* to the bottom surface 20*a* of the upper stage side connector housing 20. Also, in the respective rear portions of the two side surfaces 20*b* and 20*b* of the upper stage side connector housing 20, are triangular-prism-shaped projections (securing portions) 24 disposed in such a manner that they are formed integrally therewith and are projected therefrom. Further, in the central portion of the upper surface 20*c* of the upper stage side connector housing 20, there is integrally and projectingly provided a flexible lock arm 25 which can be secured to and removed from a mating connector (not shown).

The lower stage side connector housing 30 is formed of synthetic resin in a substantially box-like shape and, between the front and rear end portions of the connector housing 30, there are formed, in parallel a plurality of terminal storage chambers 31. The rear portion of a bottom surface 30*a* of the lower stage side connector housing 30 is formed as an opening 31*a* which is used to expose part of a terminal (not shown) stored in each of the terminal storage chambers 31 and one end side of an electric wire W connected to the present terminal. Also, as shown in FIGS. 1 and 2, in the central portion of an upper surface 30*c* of the lower stage side connector housing 30 as well as on the two sides of the central portion, there are formed first securing recessed portions 32 each having a substantially inverted trapezoidal section in such a manner that they extend in the longitudinal direction of the connector housing 30 and in parallel to one another, so that the first securing projecting portions 22 of the upper stage side connector housing 20 can be respectively fitted with the first securing recessed portions 32. Further, at the positions of the connector housing 30 that not only exist in the two end portions of the upper surface 30*c* of the lower stage side connector housing 30 and in the front side portions of the two side surfaces 30*b* and 30*b* but also extend in a direction crossing at right angles to the first securing recessed portions 32, there are formed second securing recessed portions 33 each having a substantially L-shaped front surface section. Thus, the second securing projecting portions 23 of the upper stage side connector housing 20 can be respectively fitted with the second securing recessed portions 33 of the lower stage side connector housing 30.

As shown in FIGS. 1 and 3, each of the pair of right and left second securing recessed portions 33 and 33 includes a guiding tapered recessed portion 33*b* into which its associated introducing rib 23*a* and introducing tapered projecting portion 23*b* can be inserted, and a horizontal recessed portion 33*c* into which its associated flat projecting portion 23*c* can be inserted. Also, in the respective rear portions of the two side surfaces 30*b* and 30*b* of the lower stage side connector housing 30, there are provided integrally and projectingly frame-shaped engaging pieces (engaging portions) 34 each having a rectangular-shaped engaging hole 34*a* to which its associated projection 24 of the upper stage side connector housing 20 can be secured; and, at the same time, in the respective lower portions of the engaging pieces 34, there are provided integrally and projectingly triangular-prism-shaped projections (securing portions) 35. Further, in the rear portion of the upper surface 30*c* of the lower stage side connector housing 30, there is provided integrally and projectingly a wire hold portion 36 which is used to close the opening 21*a* of the upper stage side connector housing 20.

As shown in FIG. 1, before the upper and lower stage side connector housings 20 and 30 are connected together (combined together), the cover 40 is disposed integrally with the bottom surface 30*a* of the lower stage side connector housing 30 through a hinge portion and a band portion (neither of which are shown) and, after combined together, the band portion is cut off and is then moved through the hinge portion to the opening 31*a* side of the terminal storage chamber 31 to thereby close the opening 31*a*. In this closing operation, frame-shaped engaging pieces (engaging portions) 44, which are respectively provided in the rear portions of the two side portions of the cover 40 formed of synthetic resin and include rectangular-shaped engaging holes 44*a*, are secured to the triangular-prism-shaped projections 35 provided in the rear portions of the two side surfaces 30*b* and 30*b* of the lower stage side connector housing 30.

According to the combined connector 10 structured in accordance with the above-mentioned embodiment, when the upper and lower stage side connector housings 20 and 30 are piled up and combined together, the first securing projecting portions 22 and second securing projecting portions 23 of the upper stage side connector housing 20 are respectively fitted into the first securing recessed portions 32 and second securing recessed portions 33 of the lower stage side connector housing 30. In this combining operation, when the upper and lower stage side connector housings 20 and 30 are shifted in the back and forth directions from each other, the circular portions of the leading end portions of the introducing ribs 23*a* of the second securing projecting portions 23 provided on the two side portions of the upper stage side connector housing 20 are respectively inserted into the second securing recessed portions 33 of the lower stage side connector housing 30 to thereby match the centers of the upper and lower stage side connector housings 20 and 30 with each other. Also, when the upper and lower stage side connector housings 20 and 30 are shifted in the right and left directions from each other, the introducing tapered projecting portions 23*b* of the second securing projecting portions 23 provided on the two side portions of the upper stage side connector housing 20 are guided and inserted into the guiding tapered recessed portions 33*b* of the second securing recessed portions 33 formed in the lower stage side connector housing 30 to thereby match the centers of the upper and lower stage side connector housings 20 and 30 with each other. Due to this, the centers of the upper and lower stage side connector housings 20 and 30 can be matched with each other to thereby be able to correct simply the positional difference between the upper and lower stage side connector housings 20 and 30 in the back and forth directions thereof as well as in the right and left directions thereof, so that the upper and lower stage side connector housings 20 and 30 can be combined together simply and positively.

In this manner, since the positional difference between the upper and lower stage side connector housings 20 and 30 in the back and forth directions thereof as well as in the right and left directions thereof can be prevented when they are combined together, the respective connector housings 20 and 30 can be positioned easily and positively. Also, the variations in the engaging or fitting forces of the first and second securing projecting portions 22 and 23 as well as the first and second securing recessed portions 32 and 33 to be engaged with the first and second securing projecting portions 22 and 23 can be reduced as much as possible, which makes it possible to prevent a clearance from being produced between the respective connector housings 20 and 30 after they are combined together. Further, the fitting engagement between the respective connector housings 20 and 30 by means of the fitting engagement between the first and second securing recessed portions 32, 33 and the first and second securing projecting portions 22, 23 can be reinforced further by the fitting engagement between the projections 24 of the upper stage side connector housing 20 and the engaging holes 34*a* of the engaging pieces 34 of the lower stage side connector housing 30, so that the variations in the engaging force between the respective connector housings 20 and 30 as well as the generation of the clearance between them can be prevented positively.

By the way, in the above-mentioned embodiment, description has been given of the combined connector structured such that the connector housings are piled up and secured together in two stages, that is, in the upper and lower stages. However, this is not limitative but, of course, the above-mentioned embodiment can also apply to a combined connector structured such that the connector housings are piled up and secured together in three or more stages.

As has been described heretofore, according to the invention, the positional difference between the upper and lower stage side connector housings in the back and forth directions thereof as well as in the right and left directions thereof can be prevented when they are combined together, so that the respective connector housings can be positioned easily and positively. Also, the variations in the engaging or fitting forces between the first and second securing projecting portions and the first and second securing recessed portions can be reduced as much as possible, which makes it possible to prevent a clearance from being produced between the respective connector housings after they are combined together.

What is claimed is:

1. A combined connector comprising:

a plurality of connector housings each including a plurality of terminal storage chambers disposed in parallel therein, each of said plurality of connector housings having a mating surface;

a first securing projecting portion provided on said mating surface of one of said plurality of connector housings and disposed in a predetermined orientation;

a first securing recessed portion provided in said mating surface of another of said plurality of connector housings and operable to respectively receive said first securing projecting portion;

a second securing projecting portion provided on said mating surface of said one of said plurality of connector housings and disposed substantially perpendicular to said first securing projecting portion and said first securing recessed portion; and a second securing recessed portion provided in said mating surface of said another of said plurality of connector housings and operable to respectively receive said second securing projecting portion, wherein each of said plurality of said connector housings are operable to be stacked upon one another by relatively movement in a vertical direction perpendicular to said mating surfaces with said mating surfaces in opposition to one another and wherein said second securing projecting portion comprises a rib having a rounded end portion and a tapered projection portion extending from said rib.

2. The combined connector as set forth in claim 1, wherein a guiding tapered recessed portion is formed in said second securing recessed portion so that said tapered projection portion being fitted in said guiding tapered recessed portion.

3. The combined connector as set forth in claim 1, wherein said second securing projecting portion is provided on a front side of one side portion of said one connector housing, wherein said second securing recessed portion is provided on a corresponding front side of a corresponding side portion of said another connector housing, wherein a substantially triangular-shaped securing portion is provided on a rear side of one side portion of said one connector housing, and wherein a frame-shaped securing portion, into which said securing portion is fitted, is provided on a corresponding rear side of a side portion of said another connector housing.

4. The combined connector as set forth in claim 1, wherein said first securing projecting portion extends parallel to said plurality of terminal storage chambers, and wherein said first securing projecting portion has one of a substantially rectangular and trapezoidal cross-section.

5. The combined connector as set forth in claim 4, wherein said first securing recessed portion adapted to respectively receive said first securing projecting portion extends parallel to said plurality of terminal storage chambers, and wherein said first securing recessed portion forms a groove in said mating surface of said another connector housing.

6. The combined connector as set forth in claim 5, wherein said first securing projecting portion extends along said mating surface of said one connector housing.

7. The combined connector as set forth in claim 6, wherein at least one of said first securing projecting portion is disposed between a plurality of said second securing projecting portion on a mating surface of said one connector housing and at least one of said first securing recessed portions are disposed between a plurality of said second securing recessed portions on said mating surface of said another connector housing.

8. The combined connector as set forth in claim 1, wherein each of said second securing projecting portion and said second securing recessed portion are disposed perpendicular to said plurality of terminal storage chambers.

9. The combined connector as set forth in claim 8, and wherein said second securing recessed portion forms a groove in said mating surface of said another connector housing.

10. The combined connector as set forth in claim 9, wherein at least one of said first securing projecting portions is disposed between a plurality of said second securing projecting portions on said mating surface of said one connector housing and at least one of said first securing recessed portions are disposed between a plurality of said second securing recessed portions on said mating surface of said another connector housing.

11. The combined connector as set forth in claim 1, wherein at least one of said first securing projecting portions is disposed between a plurality of said second securing projecting portions on said mating surface of said one connector housing and at least one of said first securing recessed portions are disposed between a plurality of said second securing recessed portions on said mating surface of said another connector housing.

* * * * *